US005630582A

United States Patent [19]

Peebles et al.

[11] Patent Number: 5,630,582

[45] Date of Patent: May 20, 1997

[54] SHEET SEPARATING APPARATUS

[75] Inventors: John A. Peebles, Dundee; Robert J. Suttie, Perthshire, both of Scotland

[73] Assignee: NCR Corporation, Dayton, Ohio

[21] Appl. No.: 644,016

[22] Filed: May 9, 1996

[30] Foreign Application Priority Data

Dec. 8, 1995 [GB] United Kingdom ..... 9525106

[51] Int. Cl.[6] ..... B65H 3/08

[52] U.S. Cl. ..... 271/90; 271/100

[58] Field of Search ..... 406/171, 172; 271/11, 20, 90, 99, 100, 107, 194

[56] References Cited

U.S. PATENT DOCUMENTS 3,069,205 12/1962 McIver et al. ..... 406/172
3,597,594 8/1971 Evans ..... 235/92 R
3,999,795 12/1976 Barker ..... 271/90
5,366,214 11/1994 Sato ..... 271/100

FOREIGN PATENT DOCUMENTS 0381382 8/1990 European Pat. Off. ..... 271/90
0448385 9/1991 European Pat. Off. .

*Primary Examiner*—H. Grant Skaggs
*Attorney, Agent, or Firm*—Michael Chan

[57] ABSTRACT

In sheet separating apparatus suitable for use in an automated teller machine (ATM), sheets, such as banknotes, are removed singly from a stack (14) using reduced pressure derived from a vacuum pump (86). An air filter (72) is provided in the vacuum supply line (16) from the vacuum pump (86). A pressure sensor (68) senses the pressure in the vacuum supply line (16) and when this rises to a threshold value, causes the vacuum pump to supply reverse air flow through the air filter (72) to transport any dust particles impeding the operation of the air filter (72) to a dust collection container (106).

16 Claims, 3 Drawing Sheets

SHEET SEPARATING APPARATUS

BACKGROUND OF THE INVENTION

This invention relates to sheet separating apparatus for removing sheets singly from a stack of sheets.

The invention has application, for example, to a currency note picking apparatus for extracting notes from a currency cassette used in an automated teller machine (ATM). As is well known, in operation of an ATM a user inserts a customer identifying card into the machine and then enters certain data (such as codes, quantity of currency required, type of transaction, etc.) upon one or more keyboards associated with the machine. The machine will then process the transaction, update the user's account to reflect the current transaction, dispense cash, when requested, extracted from one or more currency cassettes mounted in the machine, and return the card to the user as part of a routine operation.

One known type of sheet separating apparatus is described in European Patent Application No. 0 448 385. Vacuum operated picking devices apply suction force to the end note in a stack of notes in a cassette, and move the notes towards rollers which move the notes to the cash dispensing part of the apparatus. In this example, the suction force is removed by venting the suction device to the atmosphere. Inevitably, dust and grit are drawn into the system from the atmosphere, and the associated vacuum pump initially becomes inefficient, and eventually fails. Depending on the environment, the period between failures varies from about a year in relatively clean atmospheres to as little as a week in atmospheres with a high percentage of dust or even sand. Repairing the apparatus on a frequent basis is, of course, expensive.

SUMMARY OF THE INVENTION

It is an object of the present invention to provide sheet separating apparatus which has a low degree of sensitivity to contamination by dust.

Therefore, according to the present invention, there is provided a sheet separating apparatus for removing sheets singly from a stack of sheets, including suction means adapted to cooperate with the top sheet of said stack, and vacuum pump means adapted to supply a reduced pressure to said suction means, characterized by: air filter means connected between said vacuum pump means and said suction means, such that air is drawn by said vacuum pump means in a first direction through said air filter means to create said reduced pressure; pressure sensing means adapted to sense the pressure supplied to said suction means; and control means adapted, in response to the sensed pressure attaining a predetermined value, to cause an air flow to be supplied by said vacuum pump means through said air filter means in a second direction and towards a collection means.

BRIEF DESCRIPTION OF THE DRAWINGS

One embodiment of the present invention will now be described by way of example, with reference to the accompanying drawings, in which.

DETAILED DESCRIPTION

Figure 1:
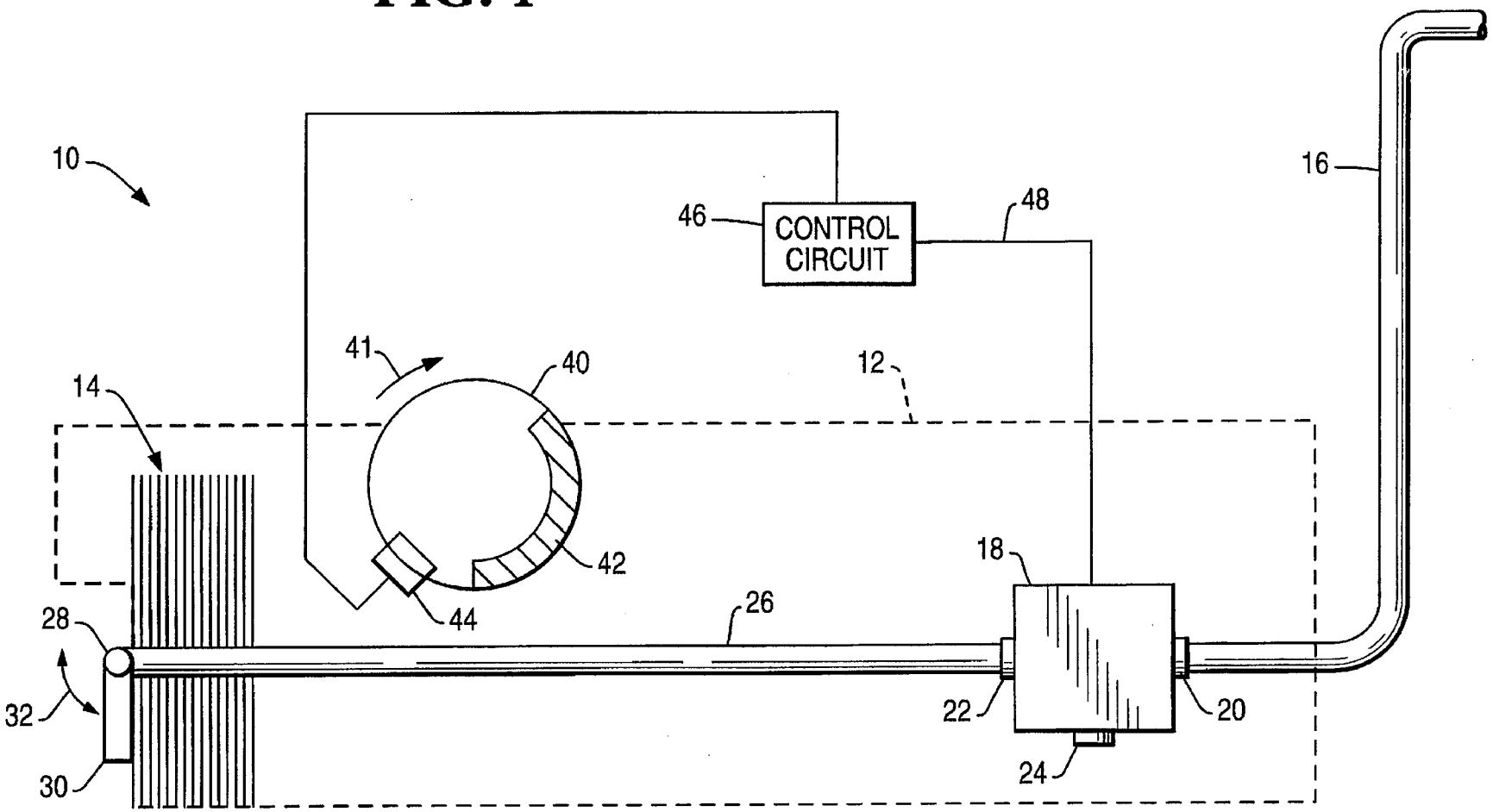
FIG. 1 shows, in diagrammatic form, a portion of apparatus for separating sheets from a stack, suitable for incorporation in an automated teller machine.
Figure 2:
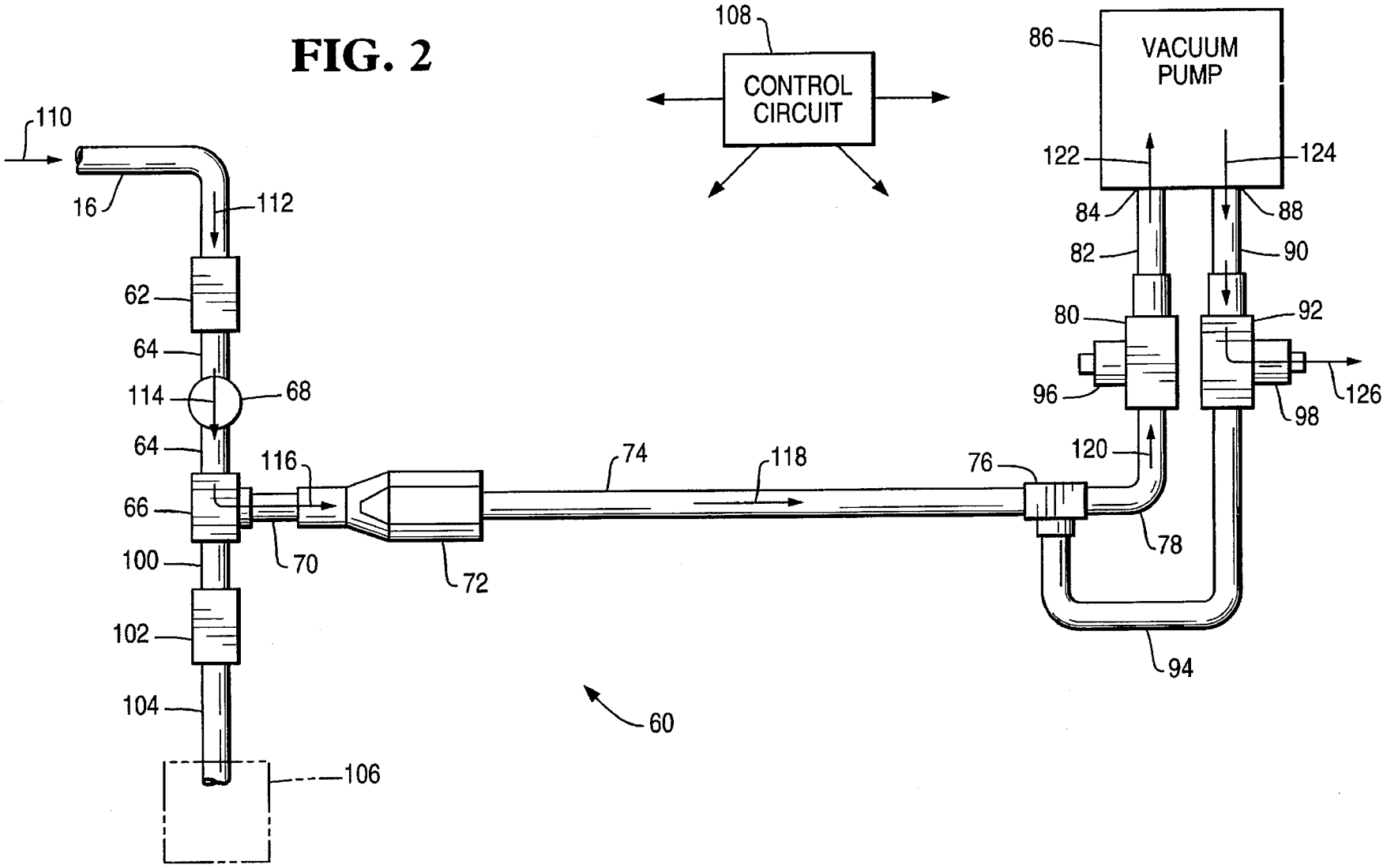
FIG. 2 shows a further portion of the apparatus shown in FIG. 1, during a first mode of operation.

Referring to FIGS. 1 and 2, there is shown apparatus for separating sheets from a stack, incorporating an adaptively cleared vacuum supply. In the preferred embodiment, the sheet-separating apparatus is embodied in an ATM (automated teller machine) and is adapted to extract banknotes singly from one or more currency cassettes, for dispensing cash in response to a cash dispense transaction request by a user operating the ATM.

The apparatus of FIGS. 1 and 2 is shown in simplified schematic form, as an aid to clarity in understanding. Referring first to FIG. 1, the apparatus 10 shown therein includes a currency cassette 12, shown in dashed outline, which contains a stack of banknotes 14. A vacuum supply tube 16 is connected to a three-way solenoid-operated valve 18 having an inlet port 20 connected to the vacuum supply line 16, an outlet port 22 and a vent port 24. The outlet port 22 is connected to a connecting tube 26, which is preferably made of an elastomeric material, such as rubber. The tube 26 is connected to a tubular member 28 which is rotatably mounted and to which are affixed a pair of pick arms 30 (only one pick arm 30 is shown in FIG. 1). The pick arms 30 carry respective suction pads (not shown) which are adapted, when operative, to adhere to a portion of the top banknote of the stack 14. The pick arms 30 then pivot about the axis of the tubular members 28, as shown by arrow 32, to move the portion of the top banknote of the stack 14 for feeding by drive rollers (not shown) to a dispensing location (not shown).

Also included in the apparatus shown in FIG. 1 is a timing disc 40 which is rotated in the direction of the arrow 41 by a drive motor (not shown) which is a source of drive power for the mechanical components in the ATM. The timing disc 40 has an opaque portion 42 and cooperates in operation with a sensor device 44. The sensor device 44 is coupled to a control circuit 46 which has an output line 48 connected to the valve 18.

It should be understood that, in a preferred embodiment, there may be more than one currency cassette, each currency cassette having an individual valve similar to the valve 18, and all the valves being connected to the vacuum supply line 16. A more detailed description of such an arrangement can be found in the aforementioned European Patent Application No. 0 448 385.

In operation of the apparatus shown in FIG. 1, when a banknote is to be extracted from the stack 14, the timing disc 40 is rotated, and when the leading edge of the opaque strip 42 is sensed, the control circuit 46 is effective to energize the solenoid of the solenoid-operated valve 18, at which time the suction pads of the pick arms 30 are in contact with the top note of the stack 14. A reduced pressure from the vacuum line 16 is thus applied to the suction pads. The pick arms 30 then pivot in a clockwise direction (FIG. 1) to transfer the top note to drive rollers (not shown). At this time the valve 18 is operated to open the vent port 24 to admit air thereby releasing the banknote from the suction pads on the pick arms 30 so that the banknote can be fed for further processing in the ATM.

Turning now to FIG. 2, there is shown apparatus 60 which provides the vacuum supply tube 16 with reduced pressure to operate the pick mechanism shown in FIG. 1, as described hereinabove. As seen in FIG. 2, the supply tube 16 is connected to a first port of a solenoid-operated valve 62, a second port of which is connected via a tube 64 to a first port of a T-member 66. The tube 64 contains a pressure sensor 68. A second port of the T-member 66 is connected to a tube 70 which is connected to an air filer 72. The air filter 72 is connected through a tube 74 to a first port of a T-member 76 which has a second port connected via a tube 78 to a first port of a three-way solenoid-operated valve 80. A second port of the valve 80 is connected via a tube 82 to an inlet port 84 of a vacuum pump 86. The vacuum pump 86 may be of piston type having a reciprocating piston and controlled inlet and outlet ports. Alternatively the vacuum pump 86 may be a diaphragm pump.

An outlet port 88 of the vacuum pump 86 is connected via a tube 90 to a first port a three-way solenoid-operated valve 92. The valve 92 has a second port connected via a tube 94 to a third port of the T-member 76. The three-way valve 80 has a third port 96 and the three-way valve 92 has a third port 98.

The T-member 66 has a third port connected via a tube 100 to a first port of a solenoid-operated valve 102 which has a second port connected via a tube 104 to a dust collection area such as a dust collection bin 106. Also provided in the apparatus 60 of FIG. 2 is electrical control circuitry 108 which is connected to control the valves 62,80,92 and 102 and is also connected to the pressure sensor 68.

It should be understood that in normal operation of the apparatus 10,60, shown in FIGS. 1 and 2, the valve 62 is open and the valve 102 is closed, thereby permitting air extraction flow as shown by arrows 110,112,114 and 116. The valve 80 is controlled once that its first and second ports are open to provide a path from the tube 78 to the tube 82, whereas the third port 96 is closed. This, air extraction flow is as shown by arrows 118, 120 and 122. The valve 92 is controlled such that its first and third ports are open and its second port is closed, whereby air extraction flow is as shown by arrows 124 and 126. With this control of the valves 62,80, 92 and 102, it will be appreciated that the vacuum pump 86 maintains a low pressure in the vacuum supply line 16, for periodic application to the suction pads on the pick arms 30 (FIG. 1) for use in separating the top banknote from the stack 14.

One problem which arises with apparatus 10,60 shown in FIGS. 1 and 2 is that, as a result of the periodic venting of the valve 18 (FIG. 1) to air via the port 24, during the release operation for the extracted top banknote, small solid particles, herein referred to as dust can enter the system primarily via the vent port 24 of the valve 18. These particles move through the vacuum extraction system and tend to collect in the air filter 72, thereby impeding the flow through the filter 72. In the course of time, the accumulation of dust particles in the filter 72 causes the output signal of the sensor 68 to rise. When such output rises above a predetermined threshold level, as detected, for example, by a comparator (not shown) in the control circuitry 108, the control circuitry is effective to provide signals to change the operating states of the valves 62, 80, 92 and 102.

Figure 3:
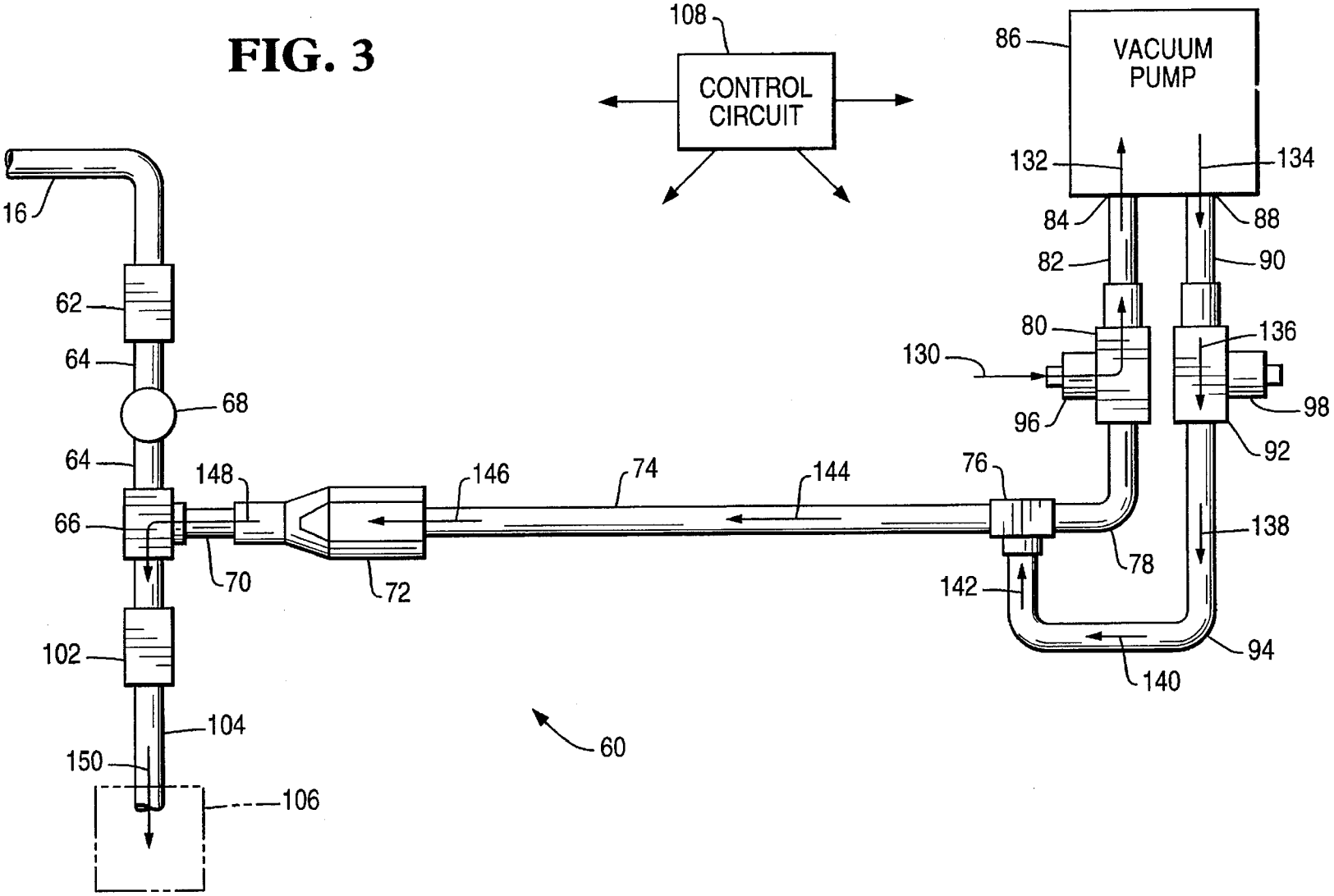
FIG. 3 is a view of the apparatus shown in FIG. 2, during a second mode of operation.

Referring now to FIG. 3, the apparatus 60 (FIG. 2) is shown with the valves 62,80,92 and 102 is their operated state, that is, the valve 62 is closed, the valve 80 provides a passage between its second and third ports, the valve 92 provides a passage between its first and second ports, and the valve 102 is open. With the vacuum pump 86 operating, it is seen that air is drawn, as shown by arrows 130, 132 (FIG. 3), from the atmosphere through the valve 80 and into the pump 86, from which it is driven, as shown by arrows 134,136,138,140, 142 and 144, via the valve 92, the T-member 76 and the tube 74, through the air filter 72 is the reverse direction to that shown in FIG. 2, as shown by arrow 146. This reverse air flow tends to remove any dust which has lodged in the filter 72. Since the valve 62 is closed and the valve 102 is open at this time, the dust is transported with the air flow indicated by the arrows 148 and 150 to the collection bin 106. The reverse air flow continues for a predetermined time, set for example, by a timer (not shown) included in the control circuitry 108. The length of such predetermined time is sufficient to remove substantially all the dust from the air filter 72. Such predetermined time may be determined experimentally during trial operations.

It will be appreciated that the described apparatus is particularly suitable for use in an ATM which is used in dusty environments and has the advantage that the need for service personnel to clean or change the air filter is reduced or eliminated.

What is claimed is:

1. Sheet separating apparatus for removing sheets singly from a stack of sheets, the sheet separating apparatus comprising:

suction means for separating the top sheet of the stack;

vacuum pump means for supplying a reduced pressure to the suction means;

air filter means connected between the vacuum pump means and the suction means such that air is drawn by the vacuum pump means in a first direction through the air filter means to create the reduced pressure;

pressure sensing means for sensing the pressure supplied to the suction means; and control means for, when the sensed pressure attains a predetermined value, causing an air flow to be supplied by the vacuum pump means through the air filter means in a second direction and towards a dust collection means.

2. Sheet separating apparatus according to claim 1, further comprising first valve means located between the suction means and the air filter means, the pressure sensing means being connected between the first valve means and the air filter means.

3. Sheet separating apparatus according to claim 2, further comprising second valve means having a first port connected to the first valve means and to the air filter means, and a second port connected to the dust collection means.

4. Sheet separating apparatus according to claim 3, further comprising third valve means having a first port connected to the air filter means, a second port connected to an inlet port of the vacuum pump means, and a third port controllable to admit an air flow from the atmosphere.

5. Sheet separating apparatus according to claim 4, further comprising fourth valve means having a first port connected to an outlet port of the vacuum pump means, a second port connected to the air filter means, and a third port controllable to expel an air flow into the atmosphere.

6. Sheet separating apparatus according to claim 1, wherein the control means includes timing means for enabling air flow in the second direction to continue for a predetermined time.

7. Sheet separating apparatus according to claim 1, wherein the sheets are banknotes.

8. Sheet separating apparatus according to claim 7, wherein the stack is housed in a currency cassette.

9. Sheet separating apparatus for removing sheets singly from a stack of sheets, the sheet separating apparatus comprising:

a suction unit for separating the top sheet of the stack;

a vacuum pump for supplying a reduced pressure to the suction unit;

an air filter connected between the vacuum pump and the suction unit such that air is drawn by the vacuum pump in a first direction through the air filter to create the reduced pressure;

a pressure sensing unit for sensing the pressure supplied to the suction unit; and a control unit for, when the sensed pressure attains a predetermined value, causing an air flow to be supplied by the vacuum pump through the air filter in a second direction and towards a dust collector.

10. Sheet separating apparatus according to claim 9, further comprising a first valve located between the suction unit and the air filter, the pressure sensing unit being connected between the first valve and the air filter.

11. Sheet separating apparatus according to claim 10, further comprising a second valve having a first port connected to the first valve and to the air filter, and a second port connected to the dust collector.

12. Sheet separating apparatus according to claim 11, further comprising a third valve having a first port connected to the air filter, a second port connected to an inlet port of the vacuum pump, and a third port controllable to admit an air flow from the atmosphere.

13. Sheet separating apparatus according to claim 12, further comprising a fourth valve having a first port connected to an outlet port of the vacuum pump, a second port connected to the air filter, and a third port controllable to expel an air flow into the atmosphere.

14. Sheet separating apparatus according to claim 9, wherein the control unit includes a timing unit for enabling air flow in the second direction to continue for a predetermined time.

15. Sheet separating apparatus according to claim 9, wherein the sheets are banknotes.

16. Sheet separating apparatus according to claim 15, wherein the stack is housed in a currency cassette.

* * * * *